US006810785B2

(12) United States Patent
Chen

(10) Patent No.: US 6,810,785 B2
(45) Date of Patent: Nov. 2, 2004

(54) STRAND FEEDING DEVICE FOR A COAXIAL CABLE BRAIDING APPARATUS

(76) Inventor: Ming Cheng Chen, No. 141, Lane 401, Sec. 1, Yung-Hsing Rd., Wu-Chi Chen, Taichung Hsien (TW)

( * ) Notice: Subject to any disclaimer, the term of this patent is extended or adjusted under 35 U.S.C. 154(b) by 67 days.

(21) Appl. No.: 10/383,993

(22) Filed: Mar. 7, 2003

(65) Prior Publication Data

US 2004/0173087 A1 Sep. 9, 2004

(51) Int. Cl.[7] ..... D04C 3/18
(52) U.S. Cl. ..... 87/56; 87/22
(58) Field of Search ..... 87/8, 9, 16, 17, 87/22, 37–40, 43, 45–49, 56

(56) References Cited

U.S. PATENT DOCUMENTS 3,686,997 A * 8/1972 Strangfeld et al. ..... 87/57
5,370,031 A * 12/1994 Koyfman et al. ..... 87/55
5,383,387 A * 1/1995 Chesterfield et al. ..... 87/56
5,520,084 A * 5/1996 Chesterfield et al. ..... 87/56
5,732,611 A * 3/1998 Voyer et al. ..... 87/56
5,904,087 A * 5/1999 Freitas et al. ..... 87/54
6,450,078 B1 * 9/2002 Frank et al. ..... 87/55

* cited by examiner

*Primary Examiner*—John J. Calvert
*Assistant Examiner*—Shaun R Hurley
(74) *Attorney, Agent, or Firm*—Rosenberg, Klein & Lee

(57) ABSTRACT

A strand feeding device includes a seat body having a top end face and a mounting bore extending downwardly and inwardly from the top end face. A bobbin-mounting post extends upwardly from the top end face of the seat body. A bobbin is sleeved rotatably around the post, and has a lower end formed with engaging grooves, each of which is confined by a groove-defining wall. A spring-biased rod is movably disposed in the mounting bore, and has a rounded surface that engages the groove-defining wall of a selected engaging groove when the rod extends into the engaging groove.

2 Claims, 7 Drawing Sheets

STRAND FEEDING DEVICE FOR A COAXIAL CABLE BRAIDING APPARATUS

BACKGROUND OF THE INVENTION

1. Field of the Invention

The present invention relates to a strand feeding device, more particularly to a strand feeding device for a coaxial cable braiding apparatus.

2. Description of the Related Art

Referring to FIGS. 1 and 2, a conventional strand feeding device 1 for a coaxial cable braiding apparatus is shown to include: a seat body 11 extending in a longitudinal direction and having a top end 110" defining a top end face 110, a mounting bore 112 extending inwardly and downwardly from the top end face 110 in the longitudinal direction, and a side face formed with a slot 113 that extends in the longitudinal direction and that is in spatial communication with the mounting bore 112; a bobbin-mounting post ill extending uprightly from the top end face 110 in the longitudinal direction; a bobbin 13 sleeved rotatably around the bobbin-mounting post 111 and having a lower end formed with a plurality of angularly spaced apart engaging grooves 114, each of which is confined by a groove-defining wall 115 that has a flat wall portion 115F; and a limiting member 15 including a spring biased rod 152 disposed movably in the mounting bore 112, and a protrusion 153 extending outwardly and transversely from the rod 152 through the slot 113. The rod 152 has a top portion formed with a flat abutment surface 152F that is vertically aligned with a selected one of the engaging grooves 114 in the lower end of the bobbin 13. The rod 152 is movable in the longitudinal direction between an upper position, in which the top portion of the rod 152 extends into the selected engaging groove 114 and the flat abutment surface 152F of the rod 152 abuts against the flat wall portion 115F of the groove-defining wall 115 of the selected engaging groove 114 so as to prevent rotation of the bobbin 13 relative to the bobbin-mounting post 111, and a lower position, in which the top portion of the rod 152 retracts into the mounting bore 112 and disengages from the selected engaging groove 114 so as to permit rotation of the bobbin 13 relative to the bobbin-mounting post 111. An urging member 151 is disposed in the mounting bore 112 for urging the rod 152 to move to the upper position. A swinging arm 14 is pivoted to the seat body 11 through a pivot shaft, and is disposed adjacent to the protrusion 153 of the rod 152. The swinging arm 14 is turnable about the pivot shaft between a released position, in which the swinging arm 14 presses the protrusion 153 against urging action of the urging member 151 to move the rod 152 to the lower position, and a locking position, in which the swinging arm 14 moves away from the protrusion 153 so as to permit restoring of the rod 152 to the upper position by the urging action of the urging member 151.

One disadvantage of the aforesaid conventional strand feeding device 1 resides in that when the rod 152 is moved to the upper position, the flat abutment surface 152F of the rod 152 fully abuts against the flat wall portion 115F of the groove-defining wall 115 of the aligned engaging groove 114 to prevent rotation of the bobbin 13 relative to the bobbin-mounting post 111. As a result, a relatively large amount of friction is present between the rod 152 and the bobbin 13 that tends to expedite wearing of the groove-defining wall 115 and that consequently shortens the service life of the conventional strand feeding device 1.

SUMMARY OF THE INVENTION

Therefore, the object of this invention is to provide a strand feeding device for a coaxial cable braiding apparatus, which includes a rod with a rounded surface, that is capable of overcoming the aforesaid drawback of the prior art.

A strand feeding device for a coaxial cable braiding apparatus according to the present invention includes: a seat body extending in a longitudinal direction, and having a top end defining a top end face, a mounting bore extending inwardly and downwardly from the top end face in the longitudinal direction, and a side face formed with a slot that extends in the longitudinal direction and that is in spatial communication with the mounting bore; a bobbin-mounting post extending uprightly from the top end face of the seat body in the longitudinal direction; a bobbin sleeved rotatably around the bobbin-mounting post and having a lower end formed with a plurality of angularly spaced apart engaging grooves, each of which is confined by a groove-defining wall; a limiting member including a spring-biased rod disposed movably in the mounting bore and a protrusion extending outwardly and transversely from the rod through the slot, the rod having a top portion that has a rounded surface and that is vertically aligned with a selected one of the engaging grooves in the lower end of the bobbin, the rod being movable in the longitudinal direction between an upper position, in which the top portion of the rod extends into the selected one of the engaging grooves and the rounded surface of rod abuts against the groove-defining wall of the selected one of the engaging grooves so as to prevent rotation of the bobbin relative to the bobbin-mounting post, and a lower position, in which the top portion of the rod retracts into the mounting bore and disengages from a vertically aligned one of the engaging grooves so as to permit rotation of the bobbin relative to the bobbin-mounting post; an urging member disposed in the mounting bore for urging the rod to move to the upper position; and a swinging arm pivoted to the seat body through a pivot shaft that extends in a transverse direction relative to the slot. The swinging arm is disposed adjacent to the protrusion of the rod, and is turnable about the pivot shaft between a released position, in which the swinging arm presses the protrusion against urging action of the urging member to move the rod to the lower position, and a locking position, in which the swinging arm moves away from the protrusion so as to permit restoring of the rod to the upper position by the urging action of the urging member.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
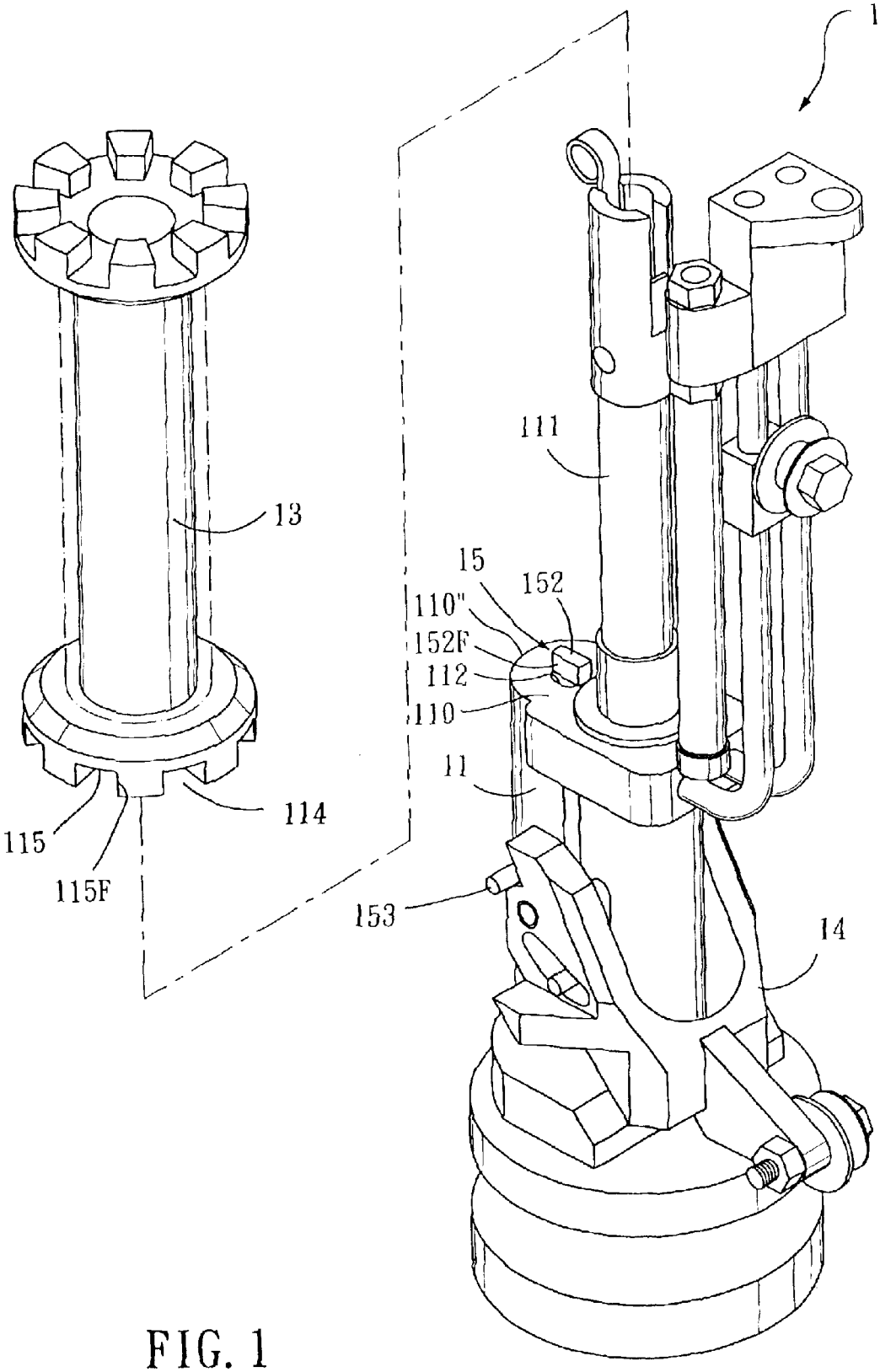
FIG. 1 PRIOR ART
FIG. 1 is an exploded and perspective view of a conventional strand feeding device for a coaxial cable braiding apparatus.
Figure 2:
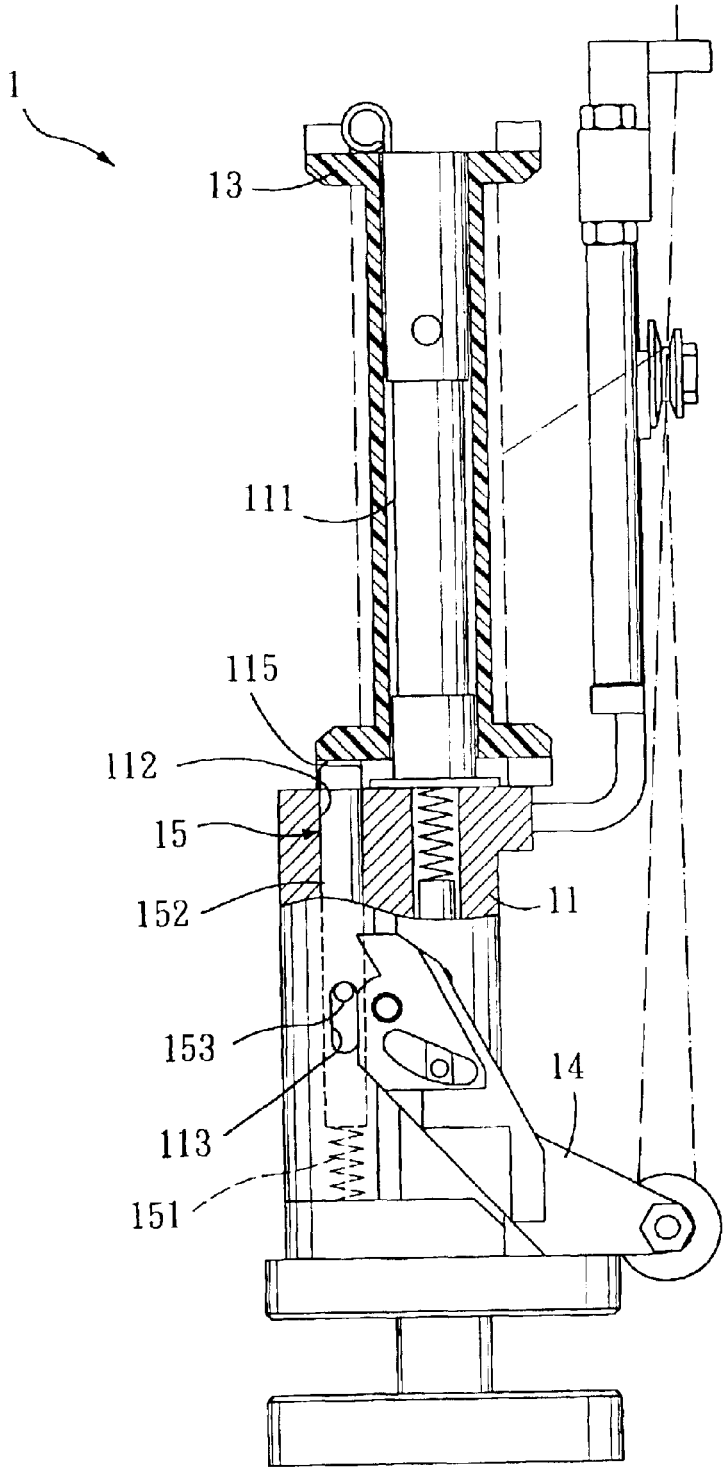
FIG. 2 PRIOR ART
FIG. 2 is a partly sectional view of the conventional strand feeding device in use.
Figure 3:
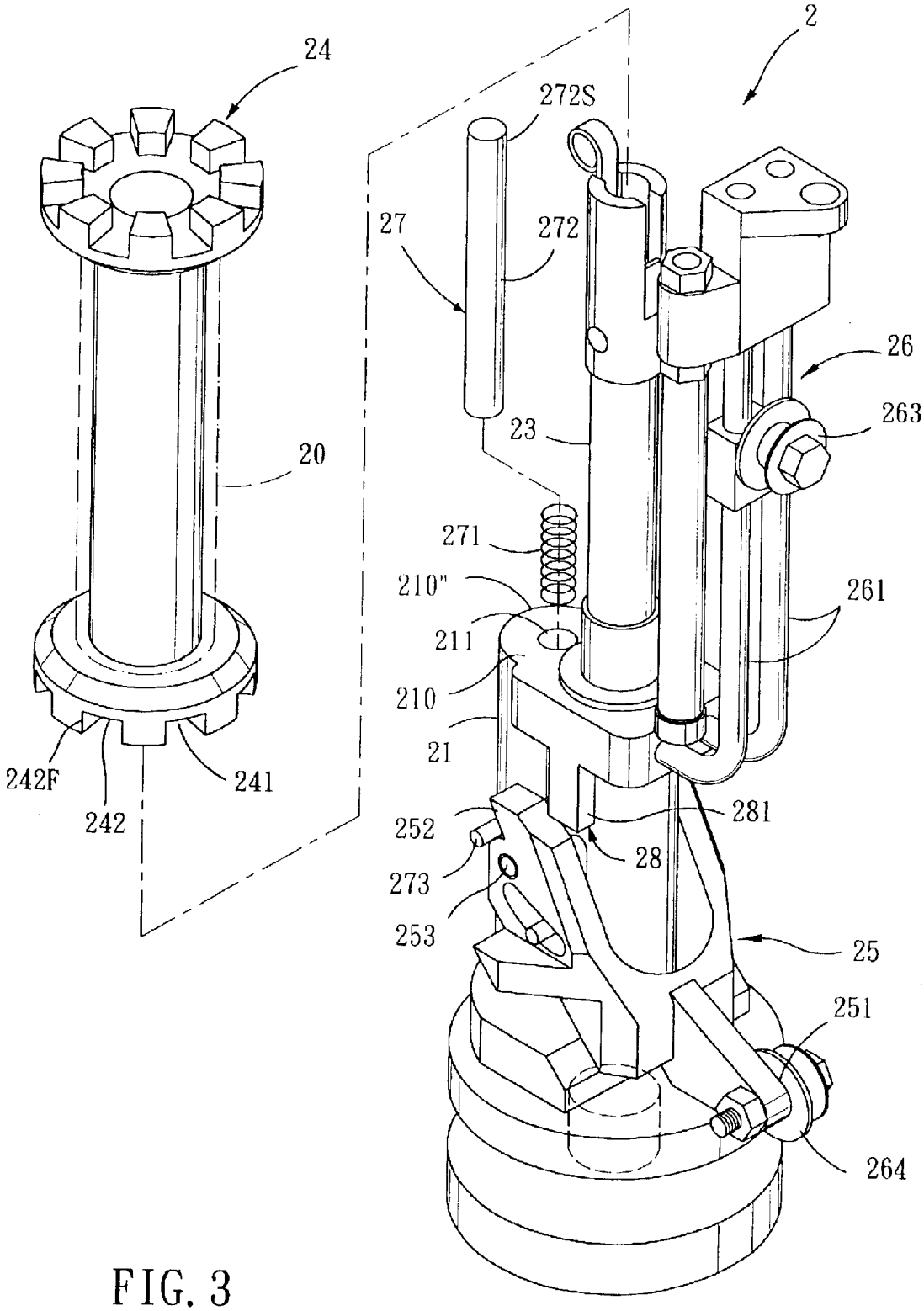
FIG. 3 is an exploded perspective view of the preferred embodiment of a strand feeding device for a coaxial cable braiding apparatus according to the present invention.

Referring to FIG. 3, the preferred embodiment of a strand feeding device 2 for a coaxial cable braiding apparatus according to the present invention is shown to include a seat body 21, a bobbin-mounting post 23, a bobbin 24, a limiting member 27, an urging member 271, and a swinging arm 25.

As illustrated, the seat body 21 extends in a longitudinal direction, and has a top end 210" defining a top end face 210, a mounting bore 211 extending inwardly and downwardly from the top end face 210 in the longitudinal direction, and a side face formed with a slot 212 (see FIG. 4) that extends in the longitudinal direction and that is in spatial communication with the mounting bore 211.

The bobbin-mounting post 23 extends uprightly from the top end face 210 of the seat body 21 in the longitudinal direction.

The bobbin 24 is sleeved rotatably around the bobbin-mounting post 23, and has a lower end formed with a plurality of angularly spaced apart engaging grooves 241. Each of the engaging grooves 241 is confined by a groove-defining wall 242 that has two opposite flat wall portions 242F. A spool of malleable conductive strand 20 is wound on the bobbin 24.

A reel-mounting member 26 extends upwardly from the top end 210" of the seat body 21, and includes a pair of posts 261 disposed parallel to the bobbin-mounting post 23. An upper strand-guiding reel 263 is mounted adjustably on the posts 261.

Figure 4:
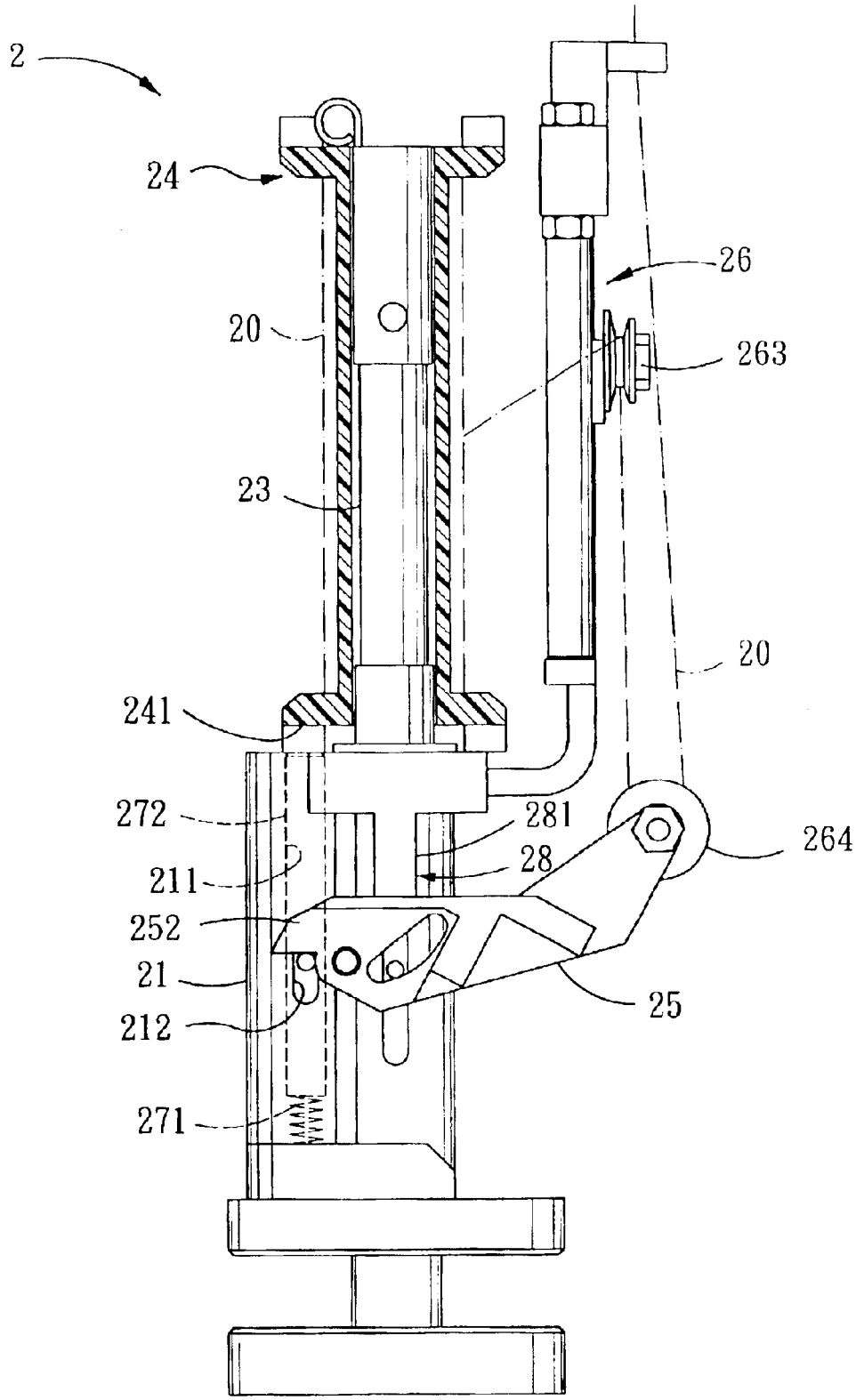
FIG. 4 is a schematic view of the preferred embodiment in a strand-feeding state.
Figure 5:
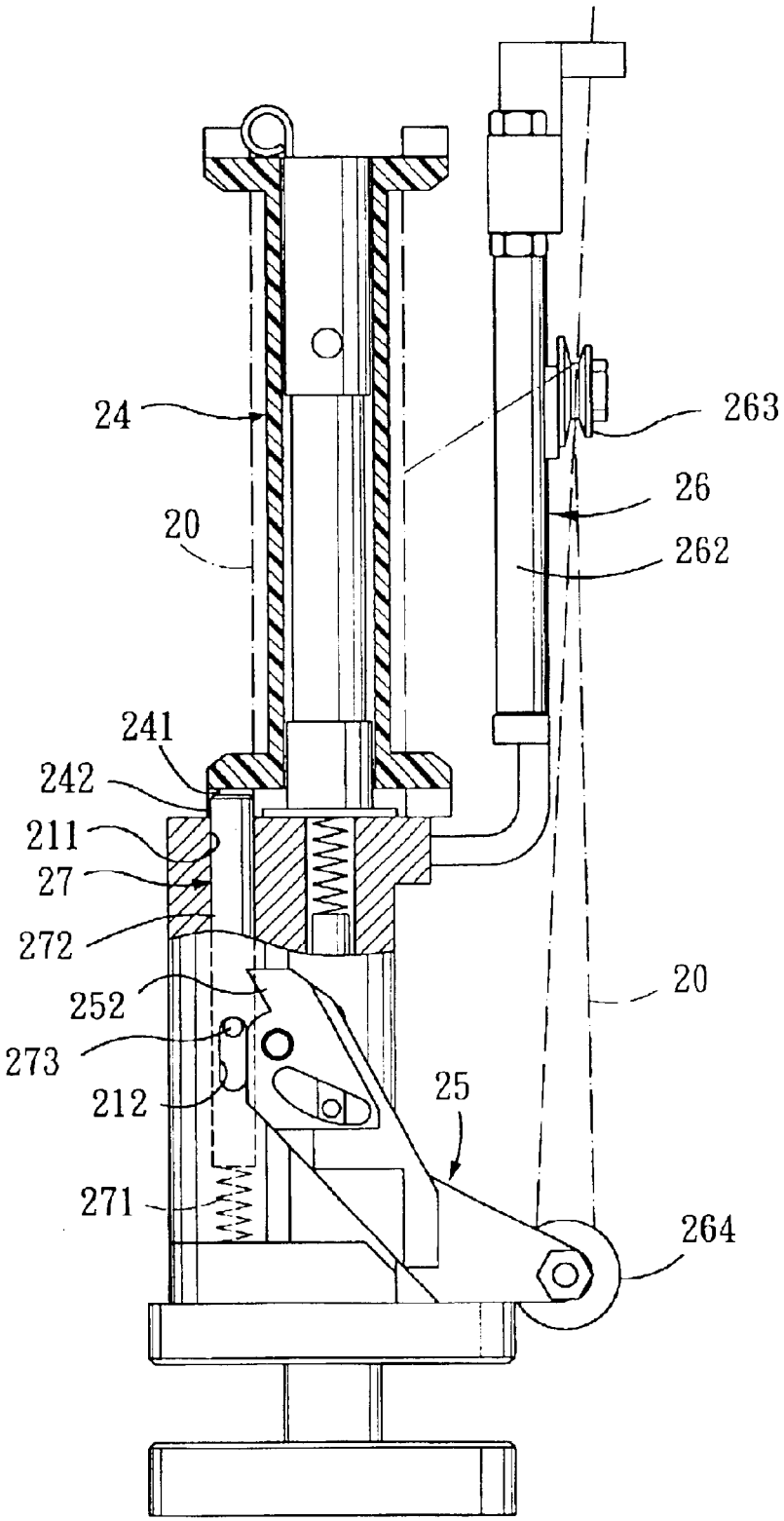
FIG. 5 is a schematic view of the preferred embodiment in a non-strand-feeding state.

The limiting member 27 includes a spring-biased rod 272 and a protrusion 273. The rod 272 is disposed movably in the mounting bore 211. The protrusion 273 extends outwardly and transversely from the rod 272 through the slot 212 in the side face of the seat body 21. The rod 272 has a top portion with a rounded surface 272S that is vertically aligned with a selected one of the engaging grooves 241 in the lower end of the bobbin 24. The rod 272 is movable in the longitudinal direction between an upper position, in which the top portion of the rod 272 extends into the selected engaging groove 241 and the rounded surface 272S of the rod 272 abuts against one of the flat wall portions 242F (see FIG. 3) of the groove-defining wall 242 of the selected engaging groove 241, as best shown in FIG. 4, so as to prevent rotation of the bobbin 24 relative to the bobbin-mounting post 23, and a lower position, in which the top portion of the rod 272 disengages from the vertically aligned engaging groove 241 and retracts into the mounting bore 211 in the seat body 21, as best shown in FIG. 5, so as to permit rotation of the bobbin 24 relative to the bobbin-mounting post 23.

The urging member 271, preferably a compression spring, is disposed within the mounting bore 211 in the seat body 21 for urging the rod 272 to move to the upper position.

The swinging arm 25 is pivoted to the seat body 21 through a pivot shaft 253 that extends in a transverse direction relative to the slot 212, and is disposed adjacent to the protrusion 273. The swinging arm 25 is turnable about the pivot shaft 253 between a released position, as shown in FIG. 4, in which the swinging arm 25 presses the protrusion 273 against urging action of the compression spring 271 to move the rod 272 to the lower position, and a locking position, in which the swinging arm 25 moves away from the protrusion 273, as shown in FIG. 5, so as to permit restoring of the rod 272 to the upper position by virtue of the urging action of the compression spring 271.

The swinging arm 25 has a distal end 251 provided with a lower strand-guiding reel 264, and a pressing end 252 formed with a pressing face for pressing the protrusion 273 when the swinging arm 25 moves to the released position. A leading strand section of the conductive stand 20 from the bobbin 24 is trained on the upper and lower strand-guiding reels 263, 264, and is subsequently fed into a braiding cone (not shown) of the braiding apparatus for braiding into a conductive sheath of a coaxial cable upon rotation of the bobbin 24 relative to the bobbin-mounting post 23. The bobbin 24 can be driven to rotate relative to the bobbin-mounting post 23 in a conventional manner. Since the feature of the present invention does not reside therein, a detailed description of the driving unit is omitted herein for the sake of brevity.

The feeding device of the present invention further includes a stopper 28 in the form of a stick 281 projecting downwardly from the top end 210" of the seat body 21 toward the swinging arm 25 in such a manner that the stick 281 abuts against the swinging arm 25 when the swinging arm 25 moves to there leased position, as best shown in FIG. 4, thereby preventing further rotation of the swinging arm 25.

Figure 6:
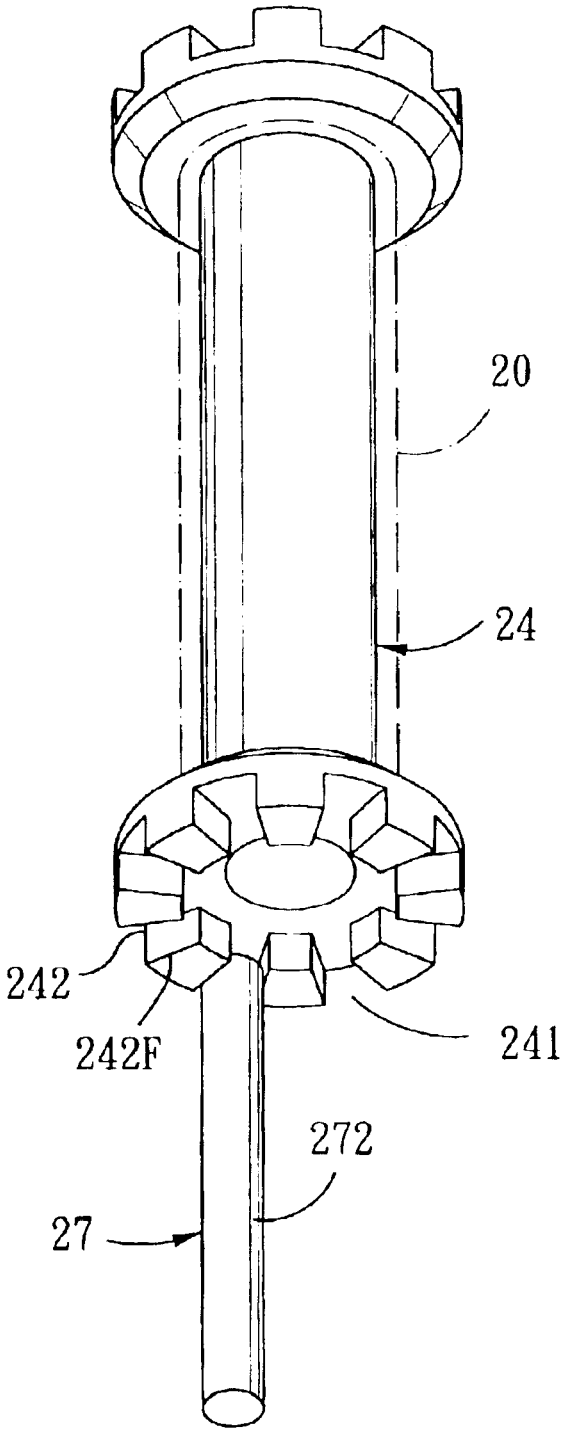
FIG. 6 is an enlarged perspective view illustrating how a spring-biased rod engages a bobbin so as to prevent rotation of the bobbin in the preferred embodiment.
Figure 7:
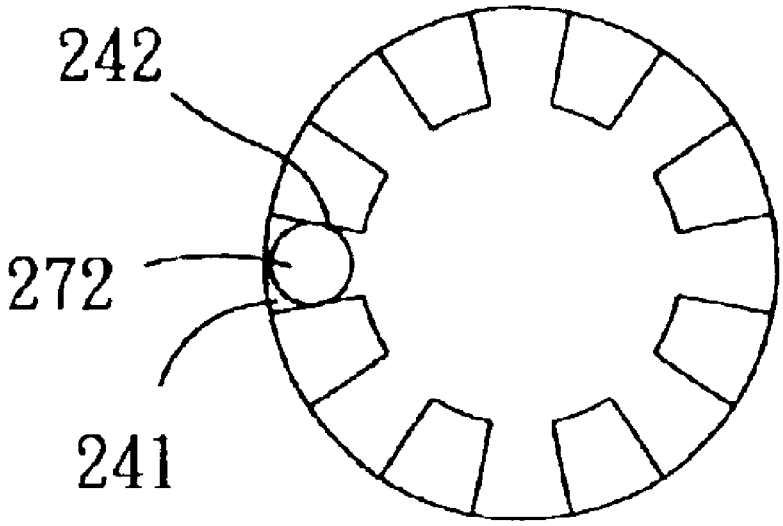
FIG. 7 is a bottom view illustrating how the spring-biased rod engages the bobbin in the preferred embodiment.

As shown in FIGS. 6 and 7, when the rod 272 is moved to the upper position, the rounded surface 272S of the rod 272 engages the flat wall portion 242F of the groove-defining wall 242 of the selected engaging groove 241 only at a line of contact. As such, the friction between the flat wall portion 242F of the groove-defining wall 242 and the rounded surface 272S of the rod 272S is considerably smaller as compared to that in the prior art described beforehand.

With this invention thus explained, it is apparent that numerous modifications and variations can be made without departing from the scope and spirit of this invention. It is therefore intended that the invention be limited only as indicated in the appended claims.

I claim:

1. A strand feeding device for a coaxial cable braiding apparatus, said strand feeding device comprising:

a seat body extending in a longitudinal direction, and having a top end defining a top end face, a mounting bore extending inwardly and downwardly from said top end face in said longitudinal direction, and a side face formed with a slot that extends in said longitudinal direction and that is in spatial communication with said mounting bore;

a bobbin-mounting post extending uprightly from said top end face in said longitudinal direction;

a bobbin sleeved rotatably around said bobbin-mounting post, and having a lower end formed with a plurality of angularly spaced apart engaging grooves, each of which is confined by a groove-defining wall;

a limiting member including a spring-biased rod disposed movably in said mounting bore, and a protrusion extending outwardly and transversely from said rod through said slot, said rod having a top portion with a rounded surface that is vertically aligned with a selected one of said engaging grooves in said lower end of said bobbin, said rod being movable in said longitudinal direction between an upper position, in which said top portion of said rod extends into said selected one of said engaging grooves and said rounded surface of said rod abuts against said groove-defining wall of said selected one of said engaging grooves so as to prevent rotation of said bobbin relative to said bobbin-mounting post, and a lower position, in which said top portion of said rod retracts into said mounting bore and disengages from a vertically aligned one of said engaging grooves so as to permit rotation of said bobbin relative to said bobbin-mounting post;

an urging member disposed in said mounting bore for urging said rod to move to said upper position; and a swinging arm pivoted to said seat body through a pivot shaft that extends in a transverse direction relative to said slot, and disposed adjacent to said protrusion of said rod, said swinging arm being turnable about said pivot shaft between a released position, in which said swinging arm presses said protrusion against urging action of said urging member to move said rod to said lower position, and a locking position, in which said swinging arm moves away from said protrusion so as to permit restoring of said rod to said upper position by the urging action of said urging member.

2. The strand feeding device as defined in claim 1, further comprising a stopper projecting downwardly from said top end of said seat body toward said swinging arm in such a mariner that said stopper abuts against said swinging arm when said swinging arm is moved to said released position.

* * * * *